US011168421B2

(12) United States Patent
Wakui et al.

(10) Patent No.: US 11,168,421 B2
(45) Date of Patent: Nov. 9, 2021

(54) ELASTIC NETWORK STRUCTURE WITH EXCELLENT QUIETNESS AND HARDNESS

(71) Applicant: Toyobo Co., Ltd., Osaka (JP)

(72) Inventors: Hiroyuki Wakui, Shiga (JP); Masahiko Nakamori, Shiga (JP)

(73) Assignee: TOYOBO CO., LTD., Osaka (JP)

( * ) Notice: Subject to any disclaimer, the term of this patent is extended or adjusted under 35 U.S.C. 154(b) by 634 days.

(21) Appl. No.: 14/399,244

(22) PCT Filed: May 7, 2013

(86) PCT No.: PCT/JP2013/062831
§ 371 (c)(1),
(2) Date: Nov. 6, 2014

(87) PCT Pub. No.: WO2013/168699
PCT Pub. Date: Nov. 14, 2013

(65) Prior Publication Data

US 2015/0087196 A1 Mar. 26, 2015

(30) Foreign Application Priority Data

May 7, 2012 (JP) ..... JP2012-105759

(51) Int. Cl.

| | |
|---|---|
| ***D04H 3/14*** | (2012.01) |
| ***B68G 11/03*** | (2006.01) |
| ***D04H 3/007*** | (2012.01) |
| ***D04H 3/03*** | (2012.01) |
| ***D04H 3/011*** | (2012.01) |
| ***D04H 3/016*** | (2012.01) |

(52) U.S. Cl.
CPC ..... *D04H 3/14* (2013.01); *B68G 11/03* (2013.01); *D04H 3/007* (2013.01); *D04H 3/011* (2013.01); *D04H 3/016* (2013.01); *D04H 3/03* (2013.01); *D10B 2401/061* (2013.01); *Y10T 442/601* (2015.04)

(58) Field of Classification Search
CPC ..... D04H 3/14; D04H 3/03; D04H 3/007; D04H 3/011; D04H 3/016; D04H 3/163; D10B 2401/061; Y10T 442/601; B68G 11/03
USPC ..... 442/50, 327–417; 428/218, 220, 340, 428/221–355 N; 297/445.1–452.65
See application file for complete search history.

(56) References Cited

U.S. PATENT DOCUMENTS

| | | | | |
|---|---|---|---|---|
| 3,852,152 | A | 12/1974 | Werner et al. | |
| 3,936,337 | A | 2/1976 | Stapp | |
| 4,012,249 | A | 3/1977 | Stapp | |
| 4,952,265 | A | 8/1990 | Yamanaka et al. | |
| 5,639,543 | A * | 6/1997 | Isoda | D04H 3/03 114/363 |
| 9,938,649 | B2 | 4/2018 | Taninaka | |
| 9,970,140 | B2 | 5/2018 | Taninaka | |
| 2003/0059606 | A1 | 3/2003 | Iijima et al. | |
| 2007/0120412 | A1 * | 5/2007 | Koyano | B62J 1/12 297/452.26 |
| 2008/0146763 | A1 * | 6/2008 | Yamanaka | D04H 3/03 526/352.2 |
| 2015/0087196 | A1 | 3/2015 | Wakui et al. | |
| 2016/0251790 | A1 | 9/2016 | Wakui et al. | |

FOREIGN PATENT DOCUMENTS

| | | | | |
|---|---|---|---|---|
| JP | S5531222 | | 8/1980 | |
| JP | H01207462 | | 8/1989 | |
| JP | 07-68061 | | 3/1995 | |
| JP | H0760861 | | 3/1995 | |
| JP | H07173753 | | 7/1995 | |
| JP | 08-013310 | | 1/1996 | |
| JP | 08196755 | A * | 8/1996 | C04B 28/04 |
| JP | 2000-073271 | | 3/2000 | |
| JP | 2000073271 | A * | 3/2000 | |
| JP | 2000-328422 | | 11/2000 | |
| JP | 2001061605 | A * | 3/2001 | |
| JP | 2010-043376 | | 2/2010 | |
| JP | 2013-090658 | A | 5/2013 | |
| JP | 2013-091862 | A | 5/2013 | |
| JP | 5418741 | | 11/2013 | |

OTHER PUBLICATIONS

Machine translation for JP 2000073271 A.*
Machine translation for JP 2001061605 A.*
Machine translation of JP 08013310 A, Jan. 16, 1996.*
Machine translation of JP 08196755 A, Aug. 6, 1996.*
Japanese Patent Office, International Search Report for International Patent Application No. PCT/JP2013/062831 (dated Aug. 13, 2013).
Office Action dated Nov. 25, 2015 issued for corresponding Chinese Application No. 201380024126.6, with English-language translation.
EESR dated Dec. 10, 2015 issued for corresponding European Application No. 13788112.4.
EPO Extended European Search Report for EP App. No. 14858724.9, dated May 16, 2017 (6 pages).

(Continued)

*Primary Examiner* — Jennifer A Boyd
*Assistant Examiner* — Elizabeth M. Dahlburg
(74) *Attorney, Agent, or Firm* — Fish & Richardson P.C.

(57) ABSTRACT

[Problem] The objective of the present invention is to provide an elastic mesh structure having exceptional cushioning and reducing noise during compression or recovery.

[Solution] A mesh structure comprising a three-dimensional, random-loop, joining structure formed by winding a continuous line of thermoplastic resin to form random loops, bringing the loops into contact with one another in a molten state, and fusing the majority of the contact area, wherein (a) the apparent density of the random-loop contact structure is 0.005-0.200 g/cm$^3$, and (b) the number of contact points per unit weight of the random-loop contact structure is 500-1200/g.

11 Claims, No Drawings

(56) References Cited

OTHER PUBLICATIONS

Office Action dated U.S. Appl. No. 15/032,506, dated Jan. 18, 2018, 6 pages.
Final Office Action in U.S. Appl. No. 15/032,506, dated May 10, 2018, 9 pages.
Interenational Search Report in International Application No. PCT/JP2014/078455, dated Jan. 27, 2014, 2 pages.
Japanese Office Action in Japanese Application No. 2013-223069, dated Mar. 11, 2014, 4 pages with English Translation.
Non Final Office Action in U.S. Appl. No. 15/032,506, dated Dec. 27, 2017, 6 pages.
USPTO Advisory Action dated Jul. 24, 2018 received for U.S. Appl. No. 15/032,506.
U.S. Patent and Trademark Office; office action mailed in U.S. Appl. No. 15/032,506 (dated Oct. 11, 2018).

* cited by examiner

ELASTIC NETWORK STRUCTURE WITH EXCELLENT QUIETNESS AND HARDNESS

TECHNICAL FIELD

The present invention relates to an elastic network structure including a three-dimensional random loop bonded structure made of a continuous linear structure.

BACKGROUND ART

There has been proposed a three-dimensional random loop bonded structure obtained by forming random loops by curling treatment of continuous linear structure including a polyester thermoplastic elastic resin, and by making each loop mutually contact in a molten state to weld the majority of contacted parts (Patent document 1). However, there has been a problem in that, when the random loop bonded structure is compressed and recovers its shape, the random loop bonded structure makes a sound like the random loops being rubbed together or a sound like the random loops being popped, and, in the case where the random loop bonded structure is used in bedding, it is loud and interrupts sleep.

In contrast to this, there has been proposed a cushioning material obtained by forming random loops by curling treatment of continuous linear structure including a polyester copolymer and having a fineness of 300 decitex or greater; making each loop mutually contact in a molten state to weld the majority of contacted parts to thereby obtain a three-dimensional random loop bonded structure; and attaching silicone resin to the surfaces of the random loops of the three-dimensional random loop bonded structure (Patent Document 2). When the cushioning material is compressed and recovers its shape, although the sound like the random loops being rubbed together is small, the sound like the random loops being popped is still given out. Therefore, there has been room for improvement in terms of quietness. Furthermore, the step of attaching silicone resin to the surfaces of the random loops is a separate step from that for the three-dimensional random loop bonded structure, and also the steps are performed in batches. Therefore, there has been a problem in terms of production.

PRIOR ART DOCUMENTS

Patent Documents

Patent Document 1: Japanese Patent Publication No. H07-68061 A

Patent Document 2: Japanese Patent Publication No. 2010-43376 A

SUMMARY OF THE INVENTION

Problems to be Solved by the Invention

An object of the present invention is to provide an elastic network structure that has excellent cushioning properties and makes less sounds when it is compressed and recovers its shape.

Means for Solving Problems

The present inventors have considered that increasing the number of bonded points of the three-dimensional random loop bonded structure would fix the random loops and reduce the frequency of the popping of the random loops and that this would improve the quietness of the network structure, and have made earnest examination. As a result, the inventors have found, by controlling the number of bonded points of the three-dimensional random loop bonded structure, a network structure makes less sounds when it is compressed and recovers its shape and has excellent cushioning properties. Then, the inventors have accomplished the present invention.

That is, the present invention includes the following configurations.

1. A network structure comprising a random loop bonded structure of a thermoplastic resin, wherein (a) the random loop bonded structure has an apparent density of 0.005 to 0.200 g/cm$^3$ and (b) a number of bonded points per unit weight of the random loop bonded structure is 500 to 1200/gram.

2. The network structure according to 1, wherein the number of bonded points per unit weight of the random loop bonded structure is 550 to 1150/gram.

3. The network structure according to 2, wherein the number of bonded points per unit weight of the random loop bonded structure is 600 to 1100/gram.

4. The network structure according to any one of 1 to 3, wherein the thermoplastic resin is at least one thermoplastic resin selected from the group consisting of a soft polyolefin, a polystyrene thermoplastic elastomer, a polyester thermoplastic elastomer, a polyurethane thermoplastic elastomer and a polyamide thermoplastic elastomer.

5. The network structure according to 4, wherein the thermoplastic resin is at least one thermoplastic resin selected from the group consisting of a soft polyolefin and a polyester thermoplastic elastomer.

6. The network structure according to 5, wherein the thermoplastic resin is a polyester thermoplastic elastomer.

7. The network structure according to any one of 1 to 6, wherein a fineness of the continuous linear structure is 200 to 10000 decitex.

8. The network structure according to 7, wherein the fineness of the continuous linear structure is 200 to 5000 decitex.

9. The network structure according to 8, wherein the fineness of the continuous linear structure is 200 to 3000 decitex.

10. The network structure according to any one of 1 to 9, wherein a 25%-compression hardness of the random loop bonded structure is not less than 5 kg/φ200-mm and not more than 50 kg/200-mm diameter.

11. The network structure according to any one of 1 to 10, wherein the continuous linear structure has a hollow cross section.

12. The network structure according to 11, wherein the continuous linear structure has a hollow cross section and a degree of hollowness of the hollow cross section is 10 to 50%.

13. The network structure according to 12, wherein the continuous linear structure has a hollow cross section and the degree of hollowness of the hollow cross section is 20 to 40%.

14. The network structure according to any one of 1 to 13, wherein the continuous linear structure has a modified cross section.

Effect of the Invention

Conventional network structures make a sound like random loops being rubbed together or a sound like the random loops being popped when the network structures are compressed or recover their shapes. In this regard, a network structure according to the present invention has excellent effects in that the network structure has, while greatly reducing the sounds, an elasticity equivalent to or greater than the conventional network structures when it is compressed.

MODE FOR CARRYING OUT THE INVENTION

A network structure according to the present invention forms a three-dimensional network structure in such a manner that a linear structure (in this specification, this may be referred to as a "continuous linear structure") including a thermoplastic resin is curled; and the linear structures are brought into mutual contact and the contacted parts are welded. Thereby, even in case of application of a large deformation based on a very large stress, whole of a network structure including three-dimensional random loops obtained by mutual welding and integration will deform to absorb a stress. Furthermore, when the stress is removed, the structure can recover an original shape thereof by an elastic force of the thermoplastic resin.

The thermoplastic resin is not particularly limited as long as the linear structures can be curled and brought into mutual contact and the contacted parts can be welded. In terms of satisfying both cushioning properties and quietness, the thermoplastic resin is preferably a soft polyolefin, a polystyrene thermoplastic elastomer, a polyester thermoplastic elastomer, a polyurethane thermoplastic elastomer or a polyamide thermoplastic elastomer, more preferably a soft polyolefin or a polyester thermoplastic elastomer. Furthermore, for the purpose of satisfying both cushioning properties and quietness while improving heat resistance and durability, a polyester thermoplastic elastomer is particularly preferable.

Preferred examples of the soft polyolefin include low density polyethylene (LDPE), random copolymers of ethylene and an α-olefin with a carbon number of not less than 3, and block copolymers of ethylene and an α-olefin with a carbon number of not less than 3. Preferred examples of the α-olefin with a carbon number of not less than 3 include propylene, isoprene, butene-1, pentene-1, hexene-1,4-methyl-1-pentene, heptene-1, octene-1, nonene-1, decene-1, undecene-1, dodecene-1, tridecene-1, tetradecene-1, pentadecene-1, hexadecene-1, heptadecene-1, octadecene-1, nonadecene-1 and eicosene-1. More preferred examples thereof include propylene and isoprene. Furthermore, two or more of these α-olefins may be used in combination.

Preferred examples of the polyester thermoplastic elastomer include polyester-ether block copolymers whose hard segment is a thermoplastic polyester and whose soft segment is a polyalkylene diol; and polyester-ester block copolymers whose soft segment is an aliphatic polyester. More specific examples of the polyester-ether block copolymer are triblock copolymers formed of at least one dicarboxylic acid selected from aromatic dicarboxylic acids such as terephthalic acid, isophthalic acid, naphthalene-2,6-dicarboxylic acid, naphthalene-2,7-dicarboxylic acid and diphenyl-4,4'-dicarboxylic acid, alicyclic dicarboxylic acids such as 1,4 cyclohexane dicarboxylic acid, aliphatic dicarboxylic acids such as succinic acid, adipic acid, sebacic acid and dimer acid, and ester-forming derivatives of these dicarboxylic acids, etc.; at least one diol component selected from aliphatic diols such as 1,4-butanediol, ethylene glycol, trimethylene glycol, tetramethylene glycol, pentamethylene glycol and hexamethylene glycol, alicyclic diols such as 1,1-cyclohexane dimethanol and 1,4-cyclohexane dimethanol, and ester-forming derivatives of these diols, etc.; and at least one polyalkylene diol selected from polyethylene glycol, polypropylene glycol, polytetramethylene glycol and ethylene oxide-propylene oxide copolymers etc. which have an average molecular weight of about 300 to 5000. Examples of the polyester-ester block copolymer include triblock copolymers formed from the above-mentioned dicarboxylic acid and diol and at least one of polyester diols such as polylactone having an average molecular weight of about 300 to 5000. In consideration of thermal bonding properties, hydrolysis resistance, flexibility and heat resistance etc., preferred polyester-ester block copolymers are (1) a triblock copolymer formed terephthalic acid and/or isophthalic acid as a dicarboxylic acid; 1,4-butanediol as a diol component; and polytetramethylene glycol as a polyalkylene diol and (2) a triblock copolymer formed terephthalic acid or/and naphthalene-2,6-dicarboxylic acid as a dicarboxylic acid; 1,4-butanediol as a diol component; and polylactone as a polyester diol. Particularly preferred is (1) a triblock copolymer formed terephthalic acid and/or isophthalic acid as a dicarboxylic acid; 1,4-butanediol as a diol component; and polytetramethylene glycol as a polyalkylene diol. In special cases, one to which a polysiloxane soft segment has been introduced can also be used.

Preferred examples of the polystyrene thermoplastic elastomer include random copolymers of styrene and butadiene, block copolymers of styrene and butadiene, random copolymers of styrene and isoprene, block copolymers of styrene and isoprene, and hydrogenated products of these.

A typical example of the polyurethane thermoplastic elastomer can include a polyurethane elastomer obtained by using a prepolymer, which has isocyanate groups at both ends and is obtained by allowing (A) a polyether and/or polyester having a number average molecular weight of 1000 to 6000 and having hydroxyl groups at end(s) to react with (B) a polyisocyanate whose main component is an organic diisocyanate in the presence or absence of usual solvent (dimethylformamide, dimethylacetamide etc.), and extending the chain of the prepolymer with (C) a polyamine whose main component is a diamine. Preferred as the (A) polyester and/or polyether are polybutylene adipate copolyesters and polyalkylene diols such as polyethylene glycol, polypropylene glycol, polytetramethylene glycol and ethylene oxide-propylene oxide copolymers, which have an average molecular weight of about 1000 to 6000, preferably 1300 to 5000. As the (B) polyisocyanate, a conventionally known polyisocyanate can be used. An isocyanate including diphenylmethane-4,4'-diisocyanate as a main component, to which a minute amount of a conventionally known triisocyanate etc. has been added according to need, may also be used. As the (C) polyamine, a polyamine including as a main component a known diamine such as ethylenediamine or 1,2-propylenediamine, to which a minute amount of a triamine and/or tetraamine has been added according to need, may also be used. These polyurethane thermoplastic elastomers may be used alone or two or more of the elastomers may be used in combination. Furthermore, the thermoplastic elastomer of the present invention also encompasses a blend of the above-mentioned elastomer and a non-elastomer component, and a copolymer of the above-mentioned elastomer and a non-elastomer component, etc.

A preferred example of the polyamide thermoplastic elastomer can include a polyamide thermoplastic elastomer obtained by using block copolymers alone or two or more of them in combination, the block copolymer including a hard segment in which Nylon 6, Nylon 66, Nylon 610, Nylon 612, Nylon 11, Nylon 12 etc. or a copolyamide of any of these nylons is used as a skeleton and a soft segment containing at least one of polyalkylene diols such as polyethylene glycol, polypropylene glycol, polytetramethylene glycol and ethylene oxide-propylene oxide copolymers having an average molecular weight of about 300 to 5000. Furthermore, those with which a non-elastomer component has been blended or copolymerized, etc. may also be used in the present invention.

The continuous linear structure included in the network structure of the present invention can be formed from a mixture of two or more different thermoplastic resins depending on the purpose. In the case where the continuous linear structure is formed from a mixture of two or more different thermoplastic resins, at least one thermoplastic resin selected from the group consisting of a soft polyolefin, a polystyrene thermoplastic elastomer, a polyester thermoplastic elastomer, a polyurethane thermoplastic elastomer and a polyamide thermoplastic elastomer is contained in an amount of preferably not less than 50% by weight, more preferably not less than 60% by weight, even more preferably not less than 70% by weight.

Depending on the purpose, various additives can be added to a resin portion of the continuous linear structure constituted the network structure of the present invention. Examples of the additives that can be added include plasticizers of phthalic acid ester type, trimellitic acid ester type, fatty acid type, epoxy type, adipic acid ester type and polyester type; antioxidants of known hindered phenol type, sulfur type, phosphorus type and amine type; light stabilizers of hindered amine type, triazole type, benzophenone type, benzoate type, nickel type and salicylic type; antistatic agents; molecular regulators such as peroxides; reactive group-containing compounds such as epoxy compounds, isocyanate compounds and carbodiimide compounds; metal deactivators; organic and inorganic nucleating agents; neutralizers; antacids; anti-microbial agents; fluorescent whitening agents; fillers; flame retardants; flame retardant aids; and organic and inorganic pigments, etc.

It is preferable that the continuous linear structure constituted the network structure of the present invention have, on a melting curve determined with a differential scanning calorimeter (DSC), an endothermic peak equal to or below the melting point. A continuous linear structure having an endothermic peak equal to or below the melting point has heat resistance and settling resistance remarkably improved as compared to that having no endothermic peak. For example, a preferred polyester thermoplastic elastomer of the present invention is obtained by performing transesterification between an acid component of hard segment containing not less than 90 mol %, more preferably not less than 95 mol %, particularly preferably 100 mol % terephthalic acid and/or naphthalene-2,6-dicarboxylic acid etc. having rigidity and a glycol component; and thereafter performing polymerization to a necessary polymerization degree; and next performing copolymerization with a preferably not less than 10% by weight and not more than 70% by weight, more preferably not less than 20% by weight and not more than 60% by weight of polytetramethylene glycol, as polyalkylene diol, having an average molecular weight of preferably not less than 500 and not more than 5000, more preferably not less than 1000 and not more than 3000. In this case, if the acid component of the hard segment contains a large amount of terephthalic acid and/or naphthalene-2,6-dicarboxylic acid having rigidity, the crystallinity of the hard segment is improved, the hard segment is unlikely to be plastically deformed, and the heat resistance and settling resistance are improved. In addition, if an annealing treatment is performed at a temperature at least 10° C. or more lower than the melting point after thermal bonding, the heat resistance and settling resistance are more improved. If the annealing is performed after a compressive strain is imparted, the heat resistance and settling resistance are even more improved. A linear structure of the network structure subjected to such a treatment more clearly shows an endothermic peak at temperatures not lower than room temperature and not higher than the melting point, on the melting curve determined with a differential scanning calorimeter (DSC). It should be noted that, in the case where the annealing is not performed, the linear structure shows no endothermic peak at temperatures not lower than room temperature and not higher than the melting point on the melting curve. Accordingly, it is assumed that the annealing causes rearrangement of the hard segment and forms pseudocrystal-like crosslinkages, and that this improves the heat resistance and settling resistance. (This annealing treatment may be hereinafter referred to as a "pseudocrystallization treatment".) The effect of this pseudocrystallization treatment also applies to a soft polyolefin, a polystyrene thermoplastic elastomer, a polyamide thermoplastic elastomer, and a polyurethane thermoplastic elastomer.

A random loop bonded structure, which is the network structure of the present invention, has an average apparent density within a range of preferably 0.005 g/cm$^3$ to 0.200 g/cm$^3$. The random loop bonded structure having an average apparent density within the above range is expected to show the function of a cushioning material. The average apparent density of less than 0.005 g/cm$^3$ fails to provide repulsive force, and thus the random loop bonded structure is unsuitable for a cushioning material. The average apparent density exceeding 0.200 g/cm$^3$ gives great repulsive force and reduces comfortableness. This is not preferable. The apparent density in the present invention is more preferably 0.010 g/cm$^3$ to 0.150 g/cm$^3$, even more preferably within a range of 0.020 g/cm$^3$ to 0.100 g/cm$^3$.

As one aspect of the network structure of the present invention, a plurality of layers including linear structures having different finenesses can be laminated together and the apparent densities of the respective layers can be made different, whereby preferable properties can be imparted. For example, a base layer may be a layer including a somewhat hard linear structure having a thick fineness, and a surface layer may be a layer that has a dense structure having a linear structure with a somewhat thin fineness and a high density. The base layer may be a layer that serves to absorb vibration and retain the shape, and the surface layer may be a layer that can uniformly transmit vibration and repulsive stress to the base layer so that the whole body undergoes deformation to be able to convert energy, whereby comfortableness can be improved and the durability of the cushion can also be improved. Moreover, for the purpose of imparting a thickness and tension to the side portion of the cushion, the fineness may be somewhat reduced partially and the density may be increased. In this way, each layer may have any preferable density and fineness depending on its purpose. It should be noted that the thickness of each layer of the network structure is not particularly limited. The thickness is preferably not less than 3 cm, particularly preferably not less than 5 cm, which is likely to show the function of a cushioning material.

The number of bonded points per unit weight of the random loop bonded structure, which is the network structure of the present invention, is preferably 500 to 1200/g. A bonded point means a welded part between two linear structures, and the number of bonded points per unit weight (unit: the number of bonded points/gram) is a value obtained by, about a piece in the form of a rectangular parallelepiped prepared by cutting a network structure into the shape of a rectangular parallelepiped measuring 5 cm in length×5 cm in width so that the rectangular parallelepiped includes two surface layers of the sample but does not include the peripheral portion of the sample, dividing the number of bonded points per unit volume (unit: the number of bonded points/$cm^3$) in the piece by the apparent density (unit: g/$cm^3$) of the piece. The number of bonded points is measured by a method of detaching a welded part by pulling two linear structures; and measuring the number of detachments. It should be noted that, in the case of a network structure that has a 0.005 g/$cm^3$ or greater band-like difference in apparent density along the length or width direction of the sample, the number of bonded points per unit weight is measured by cutting a sample so that the border between a dense portion and a sparse portion runs through the center of the piece along the length or width direction. As the number of bonded points per unit weight is larger, the linear structures are fixed, and the linear structures less frequently collide with each other, whereby the quietness of the network structure is improved. The number of bonded points per unit weight of a conventional network structure is less than 500/g. In this regard, according to the present invention, the number of bonded points per unit weight is set to not less than 500/g. This makes it possible to achieve desired effects. On the other hand, in the case where the number of bonded points per unit weight is larger than 1200/g, the network structure is less breathable and less comfortable. This is not preferable. The number of bonded points per unit weight is more preferably 550 to 1150/g, even more preferably 600 to 1100/g, yet more preferably 650 to 1050/g, particularly preferably 700 to 1000/g.

An outer surface of the network structure preferably has a surface layer portion in which a curled linear structure is bent in the middle by not less than 30°, preferably not less than 45°, and the surface is substantially flattened, and most contacted parts are welded. This greatly increases the number of contacted points of the linear structures in the surface of the network structure and forms bonded points. Therefore, local external force caused by the buttocks when a user sits down is received at the surface of the structure without feeling of a foreign substance in the buttocks, the whole surface structure undergoes deformation and the internal structure as a whole also undergoes deformation to absorb the stress, and, when the stress is removed, the rubber elasticity of the elastic resin is generated and the structure can recover its original shape. In the case where the surface is not substantially flattened, the buttocks may have feeling of a foreign substance, local external force may be applied to the surface, and the linear structures and even the bonded points in the surface may selectively cause a concentrated stress. This concentrated stress may cause fatigue and a decrease in settling resistance. In the case where the outer surface of the structure is flattened, the surface of the structure may be covered with a cover and the structure may be used for seats for vehicles, seats for trains, chairs or cushion mats for beds, sofas, mattresses and the like without the use of wadding layers or with a very thin layer of wadding. In the case where the outer surface of the structure is not flattened, the surface of the network structure needs a stack of a relatively thick (preferably not less than 10 mm) layer of wadding and needs to be covered with a cover before the structure is made into a seat or a cushion mat. Bonding the structure to a layer of wadding or a cover according to need is easy in the case where the surface is flat. However, the bonding cannot be perfect in the case where the structure is not flattened because the surface is uneven.

The fineness of the linear structure forming the network structure of the present invention is not particularly limited. A fine fineness can reduce the loudness of a sound of linear structures being popped, and, together with the effect due to the number of bonded points per unit weight, further improve the quietness of the network structure. However, in the case where the fineness is too small, the hardness of the linear structure becomes extremely small and appropriate cushioning properties cannot be maintained. In order to further improve quietness while maintaining appropriate cushioning properties, it is preferable that the fineness be 200 to 10000 decitex, more preferably 200 to 5000 decitex, even more preferably 200 to 3000 decitex. It should be noted that, in the present invention, not only a continuous linear structure including a linear structure having a single fineness may be employed, but also a combination of the use of linear structures having different finenesses and the apparent density may be employed as an optimal configuration.

The shape of a cross section is not particularly limited. A hollow cross section or a modified cross section can impart compression resistance and bulkiness and thus are preferable particularly in the case where a fine fineness is desired. The compression resistance can be adjusted depending on the modulus of a material to be used. In the case of a soft material, the gradient of initial compressive stress can be adjusted by increasing the degree of hollowness and/or degree of modification, and, in the case of a material having a relatively high modulus, compression resistance that provides comfortableness can be imparted by reducing the degree of hollowness and/or degree of modification. Another effect of the hollow cross section and the modified cross section is, by increasing the degree of hollowness and/or the degree of modification, to be able to obtain a more lightweight structure in the case where the same compression resistance is imparted. The degree of hollowness of the hollow cross section is preferably in a range of 10 to 50%, more preferably in a range of 20 to 40%.

The 25%-compression hardness of the network structure of the present invention is not particularly limited, but is preferably not less than 5 kg/φ200-mm. The 25%-compression hardness is a stress at 25%-compression on a stress-strain curve obtained by compressing the network structure to 75% with a circular compression board measuring 200 mm in diameter. In the case where the 25%-compression hardness is less than 5 kg/φ200-mm, it is not possible to obtain a sufficient elastic force, and comfortable cushioning properties are lost. The 25%-compression hardness is more preferably not less than 10 kg/φ200-mm, particularly preferably not less than 15 kg/φ200-mm. The upper limit of the 25%-compression hardness is not particularly specified, but is preferably not more than 50 kg/φ200-mm, more preferably not more than 45 kg/φ200-mm, particularly preferably not more than 40 kg/φ200-mm. In the case where the 25%-compression hardness is more than 50 kg/φ200-mm, the network structure is too hard and is not preferable in terms of cushioning properties.

Next, the following description discusses a method for producing a network structure including the three-dimensional random loop bonded structure of the present invention. The following method is one example and does not imply any limitation.

First, a thermoplastic elastomer is molten using a common melt extruder, and is heated at a temperature 10 to 120° C. higher than the melting point thereof. The molten resin is extruded out downward through a nozzle with two or more orifices, forming loops with free-fall. At this point, a distance between a nozzle face and a take-up conveyor disposed over a cooling medium for solidification of the resin, a melt viscosity of the resin, a hole size of an orifice, and an amount of discharge etc. determine a diameter of loops, a fineness of the linear structure, and the number of bonded points. A pair of take-up conveyors, having an adjustable gap, disposed over the cooling medium sandwich the discharged linear structure in a molten state, and hold the linear structure to form loops. By adjusting the gap of holes of the orifice as a gap of hole allowing contact of the formed loops, the formed loops are mutually contacted, and thereby the contacted portion mutually welds, while forming random three-dimensional loops. It should be noted that the gap between the holes of the orifices affects the number of bonded points. Subsequently, the continuous linear structure obtained by mutual welding of the contacted parts, while forming random three-dimensional shape, is continuously introduced into the cooling medium, and solidified, forming a network structure.

The pitch between the holes of the orifices needs to be a pitch that allows a sufficient contact between loops formed by the linear structure. For a dense structure, the pitch between the holes is reduced, and, for a sparse structure, the pitch between the holes is increased. The pitch between holes in the present invention is preferably 3 mm to 20 mm, more preferably 4 mm to 10 mm. In the present invention, different densities and/or different finenesses can also be achieved according to need. Layers having different densities can be formed by, for example, a configuration in which the pitch between lines or the pitch between holes is also changed, or a method of changing both the pitch between lines and the pitch between holes. Furthermore, different finenesses can be achieved by making use of the principle in which, when a pressure loss difference at the time of discharge is imparted by changing the cross sectional areas of the orifices, the amount of molten thermoplastic elastomer which is discharged with a constant pressure through a single nozzle is smaller in the case of an orifice with larger pressure loss.

Next, opposite outer surfaces of the molten three-dimensional structure are sandwiched between take-up nets, discharged molten linear structures curled in the opposite surfaces are bent and deformed by not less than 30°, whereby the surfaces are flattened while the contacted points with non-bent discharged linear structures are bonded and a structure is formed. After that, the structure is rapidly cooled continuously with a cooling medium (usually, it is preferable to use water at room temperature because this allows for quick cooling and also low costs.) to thereby obtain a network structure including the three-dimensional random loop bonded structure of the present invention. Next, the network structure is drained and dried. Here, the addition of a surfactant etc. to the cooling medium is not preferable, because this may make it difficult to drain and dry the network structure or this may cause swelling of the thermoplastic elastomer. A preferred method in the present invention includes performing a pseudocrystallization treatment after cooling. The temperature for the pseudocrystallization treatment is at least 10° C. or more lower than the melting point (Tm), and the pseudocrystallization treatment is performed at a temperature equal to or higher than the temperature (Tαcr) at the leading edge of α dispersion of Tan δ. This treatment causes the network structure to have an endothermic peak at or lower than the melting point, and remarkably improves the heat resistance and settling resistance of the network structure as compared to one that has not been subjected to the pseudocrystallization treatment (having no endothermic peak). The temperature for the pseudocrystallization treatment in the present invention is preferably (Tαcr+10° C.) to (Tm−20° C.). The pseudocrystallization by a mere heat treatment improves the heat resistance and settling resistance. Further, it is more preferable that, after cooling, not less than 10%-deformation by compression is imparted and annealing is performed because this remarkably improves the heat resistance and settling resistance. Furthermore, in the case where a drying step is provided after cooling, the drying temperature can be set as the annealing temperature, whereby the pseudocrystallization treatment can be performed at the same time. Alternatively, the pseudocrystallization treatment can be performed separately.

Next, the network structure is cut into a desired length or shape to be used for a cushioning material. In the case of using the network structure of the present invention for a cushioning material, resins, fineness, diameters of loops, and bulk density to be used need to be selected based on purposes of use and parts for use. For example, in the case where the network structure is used for surface wadding, a finer fineness and a fine diameter of loops with a lower density are preferably used in order to exhibit bulkiness having soft touch, moderate sinking and tension. In the case where the network structure is used as a middle portion cushioning body, a density of middle degree, a thicker fineness, and a little larger diameter of loops are preferred, in order to exhibit an excellent lower frequency of sympathetic vibration, a moderate hardness, good retention capacity of body shape by linear variation of hysteresis in compression, and to maintain durability. Of course, in order to make needed performance suitable for according usage, the network structure may also be used with other materials, for example, combination with hard cotton cushioning materials including staple fiber packed materials, and nonwoven fabrics. Furthermore, in a range where the performance is not reduced, there may be given treatment processing of chemicals addition for functions of flame-resistance, insect control antibacterial treatment, heat-resistance, water and oil repelling, coloring, fragrance, etc. in any stage of a process from the production to the molding and commercialization, even other than in the resin production process.

EXAMPLES

Hereinafter, the present invention will be described by way of Examples.

It should be noted that evaluations in Examples were performed in the following manner.

<Properties of Resin>

(1) Melting Point (Tm)

Using a TA50, DSC50 differential scanning calorimeter available from SHIMADZU CORPORATION, 10 g of a sample was subjected to measurement at a temperature rising rate of 20° C./minute from 20° C. to 250° C. to obtain an endothermic and exothermic curve. An endothermic peak (melting peak) temperature was found from the endothermic and exothermic curve.

(2) Flexural Modulus

With an injection molding machine, a sample piece measuring 125 mm in length×12 mm in width×6 mm in thickness was formed, and the sample piece was subjected to measurement in accordance with ASTM D790.

<Properties of Network Structure>

(1) Apparent Density

A sample was cut into the shape of a rectangular parallelepiped measuring 15 cm in length×15 cm in width so that the rectangular parallelepiped included two surface layers of the sample but did not include the peripheral portion of the sample, the heights of four corners of the rectangular parallelepiped were measured, and thereafter the volume ($cm^3$) was found, and the weight (g) of the sample was divided by the volume, whereby the apparent density ($g/cm^3$) was calculated. It should be noted that the apparent density was the average of n=4.

(2) Number of Bonded Points Per Unit Weight

First, a sample was cut into the shape of a rectangular parallelepiped measuring 5 cm in length×5 cm in width so that the rectangular parallelepiped included two surface layers of the sample but did not include the peripheral portion of the sample, whereby a piece was formed. Next, the heights of four corners of the piece were measured, and thereafter the volume (unit: $cm^3$) was found, and the weight (unit: g) of the sample was divided by the volume, whereby the apparent density (unit: $g/cm^3$) was calculated. Next, the number of bonded points in this piece was counted, the number was divided by the volume of the piece, whereby the number of bonded points per unit volume (unit: the number of bonded points/$cm^3$) was calculated. The number of bonded points per unit volume was divided by the apparent density, whereby the number of bonded points per unit weight (unit: the number of bonded points/gram) was calculated. It should be noted that a bonded point is a welded part between two linear structures. The number of bonded points was measured by a method of pulling two linear structures and detaching the welded part. Furthermore, the number of bonded points per unit weight was the average of n=2. Furthermore, in the case of a sample having a 0.005 $g/cm^3$ or greater band-like difference in apparent density along the length or width direction of the sample, the sample was cut so that the border between a dense portion and a sparse portion ran through the center of the piece along the length or width direction, and the number of bonded points per unit weight was measured in the same manner (n=2).

(3) Fineness of Linear Structure

First, a sample was cut into the shape of a rectangular parallelepiped measuring 30 cm in length×30 cm in width so that the rectangular parallelepiped included two surface layers of the sample but did not include the peripheral portion of the sample, the rectangular parallelepiped was divided into equally sized 4 cells, linear structures measuring 1 cm in length were taken at 5 places per cell, 20 places in total, and the specific gravity of each linear structure was measured at 40° C. using a density gradient tube. Next, the cross sectional area of a resin portion of each of the above-described linear structures taken at 20 places was found from a photograph enlarged with a microscope, the volume per 10000 m of the linear structure was obtained from the cross-sectional area, and thereafter the product of a specific gravity and the volume obtained represents fineness (weight in grams per 10000 m of linear structure: decitex(dtex)) (average of n=20).

(4) Degree of Hollowness

First, a sample was cut into the shape of a rectangular parallelepiped measuring 30 cm in length×30 cm in width so that the rectangular parallelepiped included two surface layers of the sample but did not include the peripheral portion of the sample, the rectangular parallelepiped was divided into equally sized 4 cells, linear structures measuring 1 cm in length were taken at 5 places per cell, 20 places in total, the linear structures were cooled with liquid nitrogen, and thereafter were cut into pieces. A cross section of each piece was observed under an electron microscope at a magnification of 50 times, the obtained image was analyzed using a CAD system and thereby the cross sectional area (A) of a resin portion and the cross sectional area (B) of a hollow portion were measured, and the degree of hollowness was calculated through the equation $\{B/(A+B)\}\times 100$ (average of n=20).

(5) 25%-Compression Hardness

A sample was cut into the shape of a rectangular parallelepiped measuring 30 cm in length×30 cm in width so that the rectangular parallelepiped included two surface layers of the sample but did not include the peripheral portion of the sample, and the 25%-compression hardness was indicated as a stress at 25% compression on a stress-strain curve obtained by compressing the rectangular parallelepiped to 75% with a compression board measuring 200 mm in diameter with TENSILON available from ORIENTEC Co., LTD. (average of n=3).

(6) Feeling of Floor Contact

On a rectangular parallelepiped sample prepared by cutting a sample into the shape of a rectangular parallelepiped measuring 50 cm in length×50 cm in width so that the rectangular parallelepiped sample included two surface layers of the sample, 30 panelists weighing 40 kg to 100 kg (the number of 20- to 39-year-old men; 5, the number of 20- to 39-year-old women: 5, the number of 40- to 59-year-old men: 5, the number of 40- to 59-year-old women: 5, the number of 60- to 80-year-old men: 5, the number of 60- to 80-year-old women: 5) sat down, and the panelists qualitatively evaluated the degree of feeling of "bumping" on the floor sensuously when they sat down. No feeling: Excellent, weak feeling: Good, moderate feeling; Moderate, strong feeling; Poor (7) Sound Deadening Property On a rectangular parallelepiped sample prepared by cutting a sample into the shape of a rectangular parallelepiped measuring 50 cm in length×50 cm in width so that the rectangular parallelepiped sample included two surface layers of the sample, 30 panelists weighing 40 kg to 100 kg (the number of 20- to 39-year-old men; 5, the number of 20- to 39-year-old women: 5, the number of 40- to 59-year-old men: 5, the number of 40- to 59-year-old women: 5, the number of 60- to 80-year-old men: 5, the number of 60- to 80-year-old women: 5) sat down, and the panelists qualitatively evaluated the sound coming from the network structure sensuously. No sound; Excellent, small sound; Good, moderate sound; Moderate, large sound; Poor

Synthesis Example 1

Dimethyl terephthalate (DMT), 1,4-butanediol (1,4-BD) and polytetramethylene glycol (PTMG: average molecular weight 1000) were charged together with a small amount of a catalyst, transesterification was performed by a conventional method, and thereafter the resultant was subjected to polycondensation with increasing temperature under reduced pressure, whereby a polyester-ether block copolymer elastomer of DMT/1,4-BD/PTMG=100/88/12 mol % was prepared. Next, 1% antioxidant was added thereto, and the resultant was mixed and kneaded, and thereafter the mixture was made into pellets. The pellets were dried in a vacuum at 50° C. for 48 hours, whereby a polyester thermoplastic elastomer raw material (A-1) was obtained. The properties of the polyester thermoplastic elastomer raw material are shown in Table 1.

Synthesis Example 2

Dimethyl terephthalate (DMT), 1,4-butanediol (1,4-BD) and polytetramethylene glycol (PTMG: average molecular weight 1000) were charged together with a small amount of a catalyst, transesterification was performed by a conventional method, and thereafter the resultant was subjected to polycondensation with increasing temperature under reduced pressure, whereby a polyester-ether block copolymer elastomer of DMT/1,4-BD/PTMG=100/84/16 mol % was prepared. Next, 1% antioxidant was added thereto, and the resultant was mixed and kneaded, and thereafter the mixture was made into pellets. The pellets were dried in a vacuum at 50° C. for 48 hours, whereby a polyester thermoplastic elastomer raw material (A-2) was obtained. The properties of the polyester thermoplastic elastomer raw material are shown in Table 1.

Synthesis Example 3

Dimethyl terephthalate (DMT), 1,4-butanediol (1,4-BD) and polytetramethylene glycol (PTMG: average molecular weight 1000) were charged together with a small amount of a catalyst, transesterification was performed by a conventional method, and thereafter the resultant was subjected to polycondensation with increasing temperature under reduced pressure, whereby a polyester-ether block copolymer elastomer of DMT/1,4-BD/PTMG=100/72/28 mol % was prepared. Next, 1% antioxidant was added thereto, and the resultant was mixed and kneaded, and thereafter the mixture was made into pellets. The pellets were dried in a vacuum at 50° C. for 48 hours, whereby a polyester thermoplastic elastomer raw material (A-3) was obtained. The properties of the polyester thermoplastic elastomer raw material are shown in Table 1.

TABLE 1

| | Number of resin | Resin composition | Properties of resin: Melting point | Properties of resin: Flexural modulus |
|---|---|---|---|---|
| Synthesis Example 1 | A-1 | DMT/1,4-BD/ PTMG = 100/88/12 | 203° C. | 0.16 Gpa |
| Synthesis Example 2 | A-2 | DMT/1,4-BD/ PTMG = 100/84/16 | 200° C. | 0.11 Gpa |
| Synthesis Example 3 | A-3 | DMT/1,4-BD/ PTMG = 100/72/28 | 170° C. | 0.05 Gpa |

Example 1

One hundred kg of the polyester thermoplastic elastomer (A-1) obtained in Synthesis Example 1, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 240° C., and discharged in an amount of 2.4 g/minute per single hole through hollow rounded orifices, each having a hole size of 3.0 mm, disposed in an interval of 6 mm in a nozzle surface area measuring 66 cm in width and 5 cm in length. Cooling water was arranged at a position 35 cm under the nozzle face. Endless nets made from stainless steel having a width of 70 cm were disposed parallel in an interval of 4 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 2.2 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Example 2

One hundred kg of the polyester thermoplastic elastomer (A-2) obtained in Synthesis Example 2, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 245° C., and discharged in an amount of 2.2 g/minute per single hole through solid rounded orifices, each having a hole size of 1.0 mm, disposed in an interval of 4 mm in a nozzle surface area measuring 64 cm in width and 3.5 cm in length. Cooling water was arranged at a position 50 cm under the nozzle face. Endless nets made from stainless steel having a width of 70 cm were disposed parallel in an interval of 3 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 2.6 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Example 3

One hundred kg of the polyester thermoplastic elastomer (A-2) obtained in Synthesis Example 1, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 230° C., and discharged in an amount of 2.4 g/minute per single hole through hollow rounded orifices, each having a hole size of 3.0 mm, disposed in an interval of 6 mm in a nozzle surface area measuring 66 cm in width and 5 cm in length. Cooling water was arranged at a position 37 cm under the nozzle face. Endless nets made from stainless steel having a width of 70 cm were disposed parallel in an interval of 4 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 1.9 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Example 4

One hundred kg of the polyester thermoplastic elastomer (A-2) obtained in Synthesis Example 2, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 230° C., and discharged in an amount of 2.4 g/minute per single hole through hollow rounded orifices, each having a hole size of 3.0 mm, disposed in an interval of 6 mm in a nozzle surface area measuring 66 cm in width and 5 cm in length. Cooling water was arranged at a position 32 cm under the nozzle face. Endless nets made from stainless steel having a width of 70 cm were disposed parallel in an interval of 4 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 1.8 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Example 5

One hundred kg of the polyester thermoplastic elastomer (A-3) obtained in Synthesis Example 3, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 200° C. and a screw speed of 130 rpm, extruded into the form of a strand in a water bath and cooled, and thereafter pellets of a resin composition were obtained. The obtained resin composition was melted at a temperature of 220° C., and discharged in an amount of 2.4 g/minute per single hole through hollow rounded orifices, each having a hole size of 3.0 mm, disposed in an interval of 6 mm in a nozzle surface area measuring 66 cm in width and 5 cm in length. Cooling water was arranged at a position 37 cm under the nozzle face. Endless nets made from stainless steel having a width of 70 cm were disposed parallel in an interval of 4.5 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 1.8 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Example 6

One hundred kg of low density polyethylene ("Nipolon Z 1P55A" available from TOSOH CORPORATION) was melted at a temperature of 200° C., and discharged in an amount of 2.0 g/minute per single hole through hollow rounded orifices, each having a hole size of 3.0 mm, disposed in an interval of 6 mm in a nozzle surface area measuring 66 cm in width and 5 cm in length. Cooling water was arranged at a position 37 cm under the nozzle face. Endless nets made from stainless steel having a width of 70 cm were disposed parallel in an interval of 4.5 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 1.7 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Comparative Example 1

One hundred kg of the polyester thermoplastic elastomer (A-1) obtained in Synthesis Example 1, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 245° C., and discharged in an amount of 3.6 g/minute per single hole through hollow rounded orifices, each having a hole size of 5.0 mm, disposed in an interval of 8 mm in a nozzle surface area measuring 64 cm in width and 4.8 cm in length. Cooling water was arranged at a position 35 cm under the nozzle face. Endless nets made from stainless steel having a width of 70 cm were disposed parallel in an interval of 4 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 2.2 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Comparative Example 2

One hundred kg of the polyester thermoplastic elastomer (A-2) obtained in Synthesis Example 2, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 235° C., and discharged in an amount of 1.6 g/minute per single hole through solid rounded orifices, each having a hole size of 1.0 mm, disposed in an interval of 6 mm in a nozzle surface area measuring 66 cm in width and 3.5 cm in length. Cooling water was arranged at a position 30 cm under the nozzle face. Endless nets made from stainless steel having a width of 70 cm were disposed parallel in an interval of 3 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 1.0 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Comparative Example 3

One hundred kg of the polyester thermoplastic elastomer (A-2) obtained in Synthesis Example 2, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 240° C., and discharged in an amount of 3.6 g/minute per single hole through hollow rounded orifices, each having a hole size of 5.0 mm, disposed in an interval of 8 mm in a nozzle surface area measuring 64 cm in width and 4.8 cm in length. Cooling water was arranged at a position 38 cm under the nozzle face. Endless nets made from stainless steel having a width of 70 cm were disposed parallel in an interval of 4 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 2.0 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Comparative Example 4

One hundred kg of the polyester thermoplastic elastomer (A-2) obtained in Synthesis Example 2, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 220° C. and a screw speed of 130 rpm, extruded into the form of a strand in a water bath and cooled, and thereafter pellets of a resin composition were obtained. The obtained resin composition was melted at a temperature of 240° C., and discharged in an amount of 1.6 g/minute per single hole through hollow rounded orifices, each having a hole size of 3.0 mm, disposed in an interval of 6 mm in a nozzle surface area measuring 64 cm in width and 4.8 cm in length. Cooling water was arranged at a position 25 cm under the nozzle face. Endless nets made from stainless steel having a width of 70 cm were disposed parallel in an interval of 4 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 1.4 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Comparative Example 5

One hundred kg of the polyester thermoplastic elastomer (A-3) obtained in Synthesis Example 3, 0.25 kg of a hindered phenol antioxidant ("ADEKA STAB AO330" available from ADEKA CORPORATION) and 0.25 kg of a phosphorus antioxidant ("ADEKA STAB PEP36" available from ADEKA CORPORATION) were mixed in a tumbler for 5 minutes. After that, the mixture was melted and kneaded with a φ57-mm twin screw extruder at a cylinder temperature of 200° C. and a screw speed of 130 rpm, extruded into the form of a strand in a water bath and cooled, and thereafter pellets of a resin composition were obtained. The obtained resin composition was melted at a temperature of 230° C., and discharged in an amount of 3.6 g/minute per single hole through hollow rounded orifices, each having a hole size of 5.0 mm, disposed in an interval of 8 mm in a nozzle surface area measuring 64 cm in width and 4.8 cm in length. Cooling water was arranged at a position 38 cm under the nozzle face. Endless nets made from stainless steel having a width of 70 cm were disposed parallel in an interval of 4 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 2.0 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

Comparative Example 6

One hundred kg of low density polyethylene ("Nipolon Z 1P55A" available from TOSOH CORPORATION) was melted at a temperature of 200° C., and discharged in an amount of 3.0 g/minute per single hole through hollow rounded orifices, each having a hole size of 5.0 mm, disposed in an interval of 8 mm in a nozzle surface area measuring 64 cm in width and 4.8 cm in length. Cooling water was arranged at a position 35 cm under the nozzle face. Endless nets made from stainless steel having a width of 70 cm were disposed parallel in an interval of 4.0 cm to form a pair of take-up conveyors, partially exposed over a water surface. The copolymer raw material extruded was taken up on this conveyor, while being welded on the contacted parts, and sandwiched from both sides. The sandwiched material was introduced into cooling water with a speed of 1.5 m/minute to be solidified, then subjected to a pseudocrystallization treatment for 15 minutes in a hot-air drier at 100° C., and then cut into a predetermined size, whereby a network structure was obtained. The properties of the obtained network structure are shown in Table 2.

TABLE 2

| | Resin material of network structure | Cross section shape of continuous linear structure | Degree of hollowness (%) | Fineness (dtex) | Thickness (cm) | Apparent density (g/cm$^3$) | Number of bonded points per unit weight (the number of bonded points/g) | 25%-Compression hardness (kg/φ200 mm) | Feeling of floor contact | Sound deadening property |
|---|---|---|---|---|---|---|---|---|---|---|
| Example-1 | A-1 | Hollow round | 31 | 1950 | 4.1 | 0.045 | 745 | 15 | Excellent | Excellent |
| Example-2 | A-2 | Solid round | 0 | 827 | 3.1 | 0.071 | 650 | 13 | Excellent | Excellent |
| Example-3 | A-2 | Hollow round | 29 | 2348 | 3.9 | 0.052 | 758 | 16 | Excellent | Excellent |
| Example-4 | A-2 | Hollow round | 27 | 2833 | 4.0 | 0.051 | 540 | 16 | Excellent | Excellent |
| Example-5 | A-3 | Hollow round | 30 | 2600 | 4.5 | 0.049 | 800 | 9 | Good | Excellent |
| Example-6 | LDPE | Hollow round | 28 | 1872 | 4.3 | 0.053 | 970 | 9 | Good | Excellent |
| Comparative Example-1 | A-1 | Hollow round | 40 | 4540 | 4.0 | 0.040 | 152 | 15 | Excellent | Poor |
| Comparative Example-2 | A-2 | Solid round | 0 | 2296 | 3.0 | 0.065 | 413 | 14 | Excellent | Poor |
| Comparative Example-3 | A-2 | Hollow round | 39 | 5603 | 4.0 | 0.045 | 160 | 15 | Excellent | Poor |
| Comparative Example-4 | A-2 | Hollow round | 28 | 3058 | 3.9 | 0.043 | 339 | 12 | Excellent | Poor |
| Comparative Example-5 | A-3 | Hollow round | 38 | 5451 | 4.0 | 0.045 | 170 | 4 | Poor | Moderate |
| Comparative Example-6 | LDPE | Hollow round | 39 | 4405 | 4.1 | 0.050 | 205 | 4 | Poor | Moderate |

INDUSTRIAL APPLICABILITY

The present invention relates to a network structure that shows excellent quietness while keeping cushioning properties. Utilizing these properties, the network structure can be used for seats for vehicles and mattresses, etc.

The invention claimed is:

1. A network structure comprising a random loop bonded structure of a continuous linear structure of a thermoplastic resin, wherein (a) the random loop bonded structure has an apparent density of 0.02 to 0.100 g/cm$^3$, (b) a number of bonded points per unit weight of the random loop bonded structure is 500 to 1200/gram, (c) the fineness of the continuous linear structure is 200 to 3000 decitex, (d) the network structure has a thickness of not less than 3 cm, and (e) a 25%-compression hardness of the random loop bonded structure is not less than 10 kg/φ200-mm and not more than 50 kg/φ200-mm diameter.

2. The network structure according to claim 1, wherein the number of bonded points per unit weight of the random loop bonded structure is 550 to 1150/gram.

3. The network structure according to claim 2, wherein the number of bonded points per unit weight of the random loop bonded structure is 600 to 1100/gram.

4. The network structure according to claim 1, wherein the thermoplastic resin is at least one thermoplastic resin selected from the group consisting of a soft polyolefin, a polystyrene thermoplastic elastomer, a polyester thermoplastic elastomer, a polyurethane thermoplastic elastomer and a polyamide thermoplastic elastomer.

5. The network structure according to claim 4, wherein the thermoplastic resin is at least one thermoplastic resin selected from the group consisting of a soft polyolefin and a polyester thermoplastic elastomer.

6. The network structure according to claim 5, wherein the thermoplastic resin is a polyester thermoplastic elastomer.

7. The network structure according to claim 1, wherein the continuous linear structure has a hollow cross section.

8. The network structure according to claim 7, wherein the continuous linear structure has a hollow cross section and a degree of hollowness of the hollow cross section is 10 to 50%.

9. The network structure according to claim 8, wherein the continuous linear structure has a hollow cross section and the degree of hollowness of the hollow cross section is 20 to 40%.

10. The network structure according to claim 1, wherein the continuous linear structure has a modified cross section.

11. The network structure according to claim 1, wherein the 25%-compression hardness of the random loop bonded structure is not less than 15 kg/φ200-mm and not more than 50 kg/φ200-mm diameter.

* * * * *